United States Patent [19]

Andonian

[11] Patent Number: 4,674,289

[45] Date of Patent: Jun. 23, 1987

[54] CRYOGENIC LIQUID CONTAINER

[76] Inventor: Martin D. Andonian, 25 Fairbanks Rd., Lexington, Mass. 02173

[21] Appl. No.: 748,866

[22] Filed: Jun. 26, 1985

[51] Int. Cl.[4] ..... F17C 1/00

[52] U.S. Cl. ..... 62/45; 62/50; 62/54; 220/446; 220/465; 220/901

[58] Field of Search ..... 62/45, 50, 54; 220/435, 220/445, 446, 465, 901

[56] References Cited

U.S. PATENT DOCUMENTS

| | | | |
|---|---|---|---|
| 2,707,377 | 5/1955 | Morrison | 62/50 |
| 2,951,348 | 9/1960 | Loveday et al. | 62/50 |
| 3,201,946 | 8/1965 | Pauliukonis | 62/45 |
| 3,232,065 | 2/1966 | Waller | 62/45 |
| 3,272,373 | 9/1966 | Alleaume et al. | 62/45 |
| 3,298,187 | 1/1967 | Short | 62/50 |
| 3,309,884 | 3/1967 | Pauliukonis | 62/45 |
| 3,369,370 | 2/1968 | Todd, Jr. et al. | 62/45 |
| 3,688,514 | 9/1972 | Prost | 62/45 |
| 4,187,956 | 2/1980 | Schrawer et al. | 62/45 |

*Primary Examiner*—Ronald C. Capossela
*Attorney, Agent, or Firm*—Robert T. Dunn

[57] ABSTRACT

A container for low temperature liquefied gas includes inner and outer shells forming a sealed evacuated space around the inner shell to insure low heat conduction from the ambient surroundings through the container to the liquefied gas in the inner shell. The container provides gas at relatively low pressure by drawing the liquefied gas from the inner shell to a heat exchanger where it evaporates and is fed to a user. A vacuum insulated access channel is provided through the shells for a fluid output tube through which the liquefied gas is drawn from the inner shell to the heat exchanger. The channel is formed by a thin wall sealing tube that conducts little heat, because the wall is so thin, sealed to the inner shell and enclosed by a support structure including a thick wall structural tube enclosing the thin wall tube and connected rigidly and sealed to the outer shell for structural support between the shells and also provides an annular space around the thin wall tube that is evacuated. The structural tube also connects securely, but moveably, to the inner shell, via a spacer made of low thermal conductivity material, so that the inner shell can move slightly within the outer shell, but not so much as to break the vacuum seal of the thin wall tube to the inner shell.

16 Claims, 4 Drawing Figures

CRYOGENIC LIQUID CONTAINER

BACKGROUND OF THE INVENTION

This invention relates to liquefied gas containers and more particularly to such containers having two walls that are sealed together and evacuated between the walls for low heat transfer and the liquid is drawn from the container through a heat exchanger where it is turned to a gas and fed on demand as a gas to a user. The advantage of such containers over high pressure gas containers for the same gas is that the gas is stored as a low (cryogenic) temperature liquid at relatively low pressure and the liquid volume stored is substantially less than the high gas pressure volume stored in conventional high pressure containers.

Heretofore, containers for low temperature liquefied gas have included an inner stainless steel shell that contains the low temperature liquified gas and an outer stainless steel shell that encloses the inner shell and is sealed to it. The space in between the shells is evacuated and the connections and support structures between the inner and outer shell are held to a minimum, because each such connection and structure is a conduit for heat. It has been the practice to provide a passage or channel at the top of the container from the outside to inside the inner shell through a thin wall stainless steel tube, sometimes called a neck, that is sealed to an opening in the inner shell and projects through and is sealed to an opening in the outer shell. The thin wall tube provides access to the inner shell from outside of the container and is thin walled so that it will be a minimum conductor of heat from the outer shell to the inner shell.

One of the problems with such prior containers is that the top end of the inner shell is supported within the outer shell only by the thin wall tube. This suspension with no support at the bottom of the container acts like a pendulum. When the container is tilted, the thin wall tube (called the neck) will often break. If the inner shell is also supported by the outer shell at the bottom of the container, the bottom support does not penetrate the shells and so does not have to make vacuum seals with them and so can be very sturdy and made of low thermal conductivity material. In that case, the lateral forces on the thin wall tube at the top when the container is tipped are worse, because the inner shell cannot swing as a pendulum against the outer shell and so the thin wall tube cannot bend to release the lateral forces and will rupture sooner than without the bottom support.

Another feature of prior containers is that the low temperature liquid, such as liquid nitrogen, is loaded into the container inner shell through a thin wall stainless steel input tube that extends from outside the container through the neck to the inner shell to substantially the bottom thereof. Low temperature liquid is drawn from the container by another stainless steel tube, the output tube, that enters the inner shell at the bottom from the evacuated space between the shells and immediately attaches to a copper tube that extends upward in the evacuated space between the shells and is attached by soldering to the inside of the outer shell. This copper tube often circles around the inner shell several times like a coil to provide a large surface area for conducting heat from the outer shell into the liquid to vaporize it as it is drawn through the copper tube. At the top of the container the copper tube connects to a stainless steel tube that penetrates and is welded to the outer shell and then to a gas output valve outside the container.

Another problem with such prior containers is that any leaks in the vacuum space between the shells will ruin the performance of the container. Any metal parts (for example support structures and the input and output tubes) and gas flow inside the output tubing running between the shells adds to the heat leak significantly.

As a consequence of these problems with prior containers and the high heat leakage, the user had to use many container loads each week to justify the cost of using the container. As mentioned, the copper vaporizer coil is soldered to the inside of the stainless steel outer shell. In order to solder these metals, corrosive flux must be used which leaves a residue that later produces gases in vacuum and so reduces the effectiveness of the vacuum space. Furthermore, because of the high conductivity of copper tubing, it is impractical to run copper tubing from the outer shell back to the inner shell of the container through the vacuum space and so several transitions are required from stainless steel to copper tubing inside the vacuum space with a soldered joint for each transition.

SUMMARY OF THE INVENTION

It is the object of the present invention to provide a liquefied gas container with double walls, evacuated between the walls for low heat conduction, wherein the disadvantages and problems with prior containers, mentioned above, are avoided. It is another object to provide a container for liquefied gas that has inner and outer shells that are sealed together and evacuated between the shells, has an access channel from outside the container to the inside shell that is enclosed by vacuum and also has an adequate structural support of the inner shell from the outer shell at the access channel and yet does not provide a ready path for conducting heat between the shells.

It is another object to provide such a container wherein the channel from outside the container to the inside shell is formed in part by relatively heavy structural members that ensure adequate structural support of the inner shell from the outer shell and such structural support does not provide a ready path for conducting heat between the shells.

It is a further object that the channel extend from the outer shell of the container to an input/output flow control system and the inner wall of such extension is enclosed by an evacuated space that is evacuated at the same time the space between the inner and outer shells is evacuated.

It is another object to provide a double walled liquefied gas container wherein the space between walls is evacuated for low heat transfer therethrough and liquefied gas is drawn from the container through a conduit in the access channel to a heat exchanger outside of the container, wherein the liquified gas is evaporated.

In accordance with the present invention, the container for low temperature liquefied gas includes inner and outer shells with an evacuated space in between surrounding the inner shell to insure low heat conduction to the liquefied gas inside. The container has a channel through the shells to inside the inner shell for an input/output fluid conduit tube through which liquefied gas is loaded into the container or drawn from the container to a heat exchanger outside of the shells. The channel is formed by a thin wall inner tube that conducts very little heat because the wall is so thin, and a thick wall structural tube that encloses the thin wall tube and provides structural support between the two shells and also provides an evacuated annular space around the thin wall tube where it extends outside the container as the neck. The thick wall structural tube connects rigidly to the outer shell and connects securely, but moveably, to the inner shell, via a spacer made of low thermal conductivity material, so that the inner shell can move laterally slightly within the outer shell, but not so much as to break the vacuum seal of the thin wall tube with the shells. Thus the inner shell is adequately supported from the outer shell by the structural tube, and yet the support structure does not provide a ready path for heat flow between the shells, because the structural tube is insulated from the inner shell by the spacer and contacts the spacer only when the inner shell moves laterally within the outer shell. This is called "Lost Motion Support". Liquefied gas is drawn from the inner shell through the fluid input/output tube that is inserted from outside the container through to the inside of the inner shell and the liquefied gas so drawn is fed through a heat exchanger outside of the container in which it is heated to gaseous state and fed on demand to the user.

DESCRIPTION OF EMBODIMENTS OF THE INVENTION

Container And Controls

Figure 1:
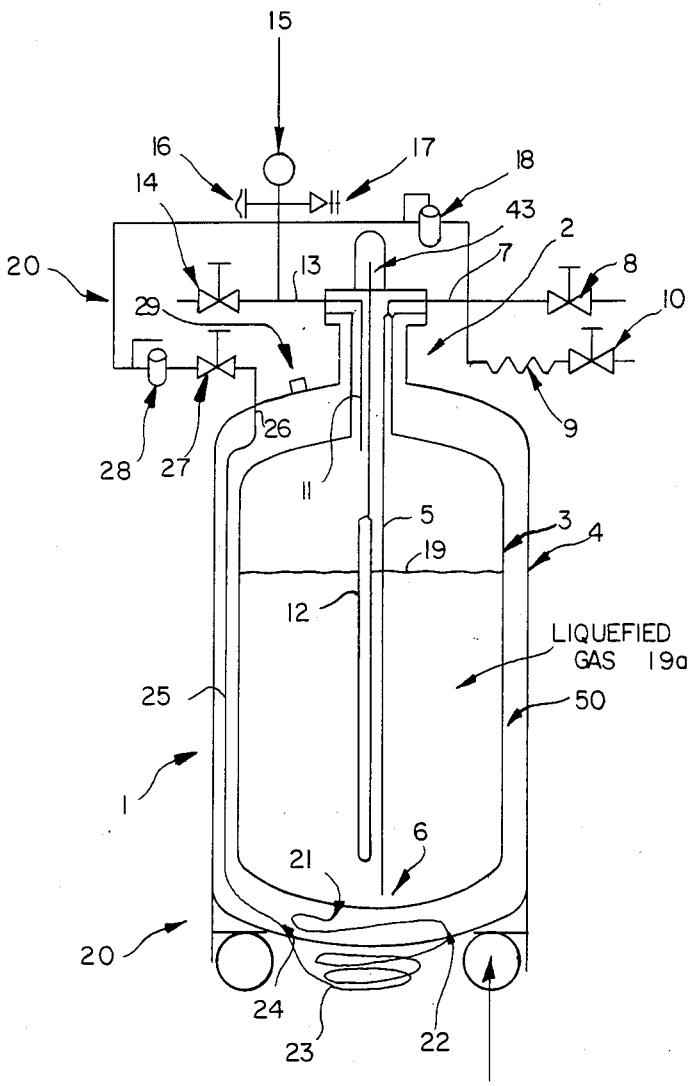
FIG. 1 is a schematic drawing of a liquefied gas container according to the present invention showing the principal parts, access channel, gas and liquid tubes, and control valves for filling the container with liquefied gas at cryogenic temperature, storing the liquified gas with relatively low vaporization lost and drawing liquid from the container, vaporizing it and feeding the gas to a user, all in accordance with the features of the present invention.

Turning first to FIG. 1 there is shown a liquefied gas container 1 that is a double walled container evacuated between the walls to thermally insulate the inside from the ambient surroundings. Access to the inside of the container for filling it with liquefied gas and for drawing liquefied gas from it and for connection to a liquid level meter 43 is all through an access channel 30 in the neck 2 at the top of the container. The neck is specially constructed according to the present invention using a support technique referred to herein as "lost motion support" so that it provides substantial structural support of the inner shell 3 of the container from the outer shell 4 when needed and, at the same time, provides access channel 30 to the inside of the inner shell 3 which is insulated by vacuum as is the rest of the container. Details of constructions of the special insulated structural neck 2 are described herein more fully with respect to FIGS. 2 and 3.

As shown in FIG. 1, an input/output liquid conduit tube 5 extends from the bottom of inner shell 3 at point 6, upwards through channel 30 of neck 2 to line 7 that connects to liquefied gas fill valve 8 and to output vaporizer coils 9 and from coils 9 to gas use valve 10. Liquid level meter 43 shows the position of float 12 extending rod 12*a*, indicating the level 19 of liquefied gas in the container.

Gas vent tube 11, extends from the top of inner shell 3 up through neck 2 to tube 13 that connects to vent valve 14, pressure gauge 15, burst disk 16, and relief valve 17. Between tubes 7 and 13 is economizer valve 18 that feeds gas from the top of the container to the vaporizer 9, whenever gas use valve 10 opens. The purpose of economizer valve 18 is to feed gas from the top of the container at 13 before liquid is drawn through tube 5 from the bottom of shell 3 and so the head of gas that builds up in the container is drawn off before liquid is drawn off for use.

A pressure building system 20 consists of pressure fitting 21 at the bottom of the inner shell that connects to another fitting 22 through the outer shell to pressure building vaporizing coil 23 and from that coil to another fitting 24 back through the outer shell to a length of rigid tubing 25 extending from fitting 24 upwards in the container in the vacuum space 50 between the shells to fitting 26 at the top of the outer shell. From fitting 26 the pressure building system goes to pressure building valve 27 and pressure regulator 28 that connects to gas line 13 at the top of gas vent tube 11. The purpose of the pressure building system is to draw liquid from the bottom of the container as necessary to build the gas pressure in the container and valve 27 and pressure regulator 28 are adjusted to accomplish this.

Typical operation of a container such as the one shown in FIG. 1 to store liquefied gas such as liquid nitrogen, oxygen, or argon, is as follows: the container may be about two feet in diameter and about six feet high and stores a maximum of 65 gallons at 235 pounds per square inch (psi) pressure. For storing liquid oxygen, such a container would hold about 525 pounds of liquid oxygen which has a gaseous equivalent (NTP) of about 6,360 cubic feet. From such a container, continuous gas flow from the gas use valve 10 in an ambient surrounding at standard temperature and pressure, is about 350 cubic feet per hour and can peak for short durations as high at 1000 cubic feet per hour. The normal daily evaporation rate of oxygen is less than 1 percent of the total capacity. The pressure relief valve 17 is set for 235 psi and the input/output tubings 5 and 7 and the gas vent line 11 and 13 are all one half inch OD tubing. A single container such as this has the equivalent capacity of approximately 24 high pressure gas cylinders with greatly reduced handling system contamination, purging and down time involved. In addition such a container is quite safe, because it operates at a maximum of 235 psig instead of about 2400 psig for compressed gas cylinders and it produces purer gas with less water contamination and it can be used for both liquid withdrawal at low pressure (about 22 psi) or gas withdrawal at pressure up to 255 psi.

Structural Insulated Neck

Figure 2:
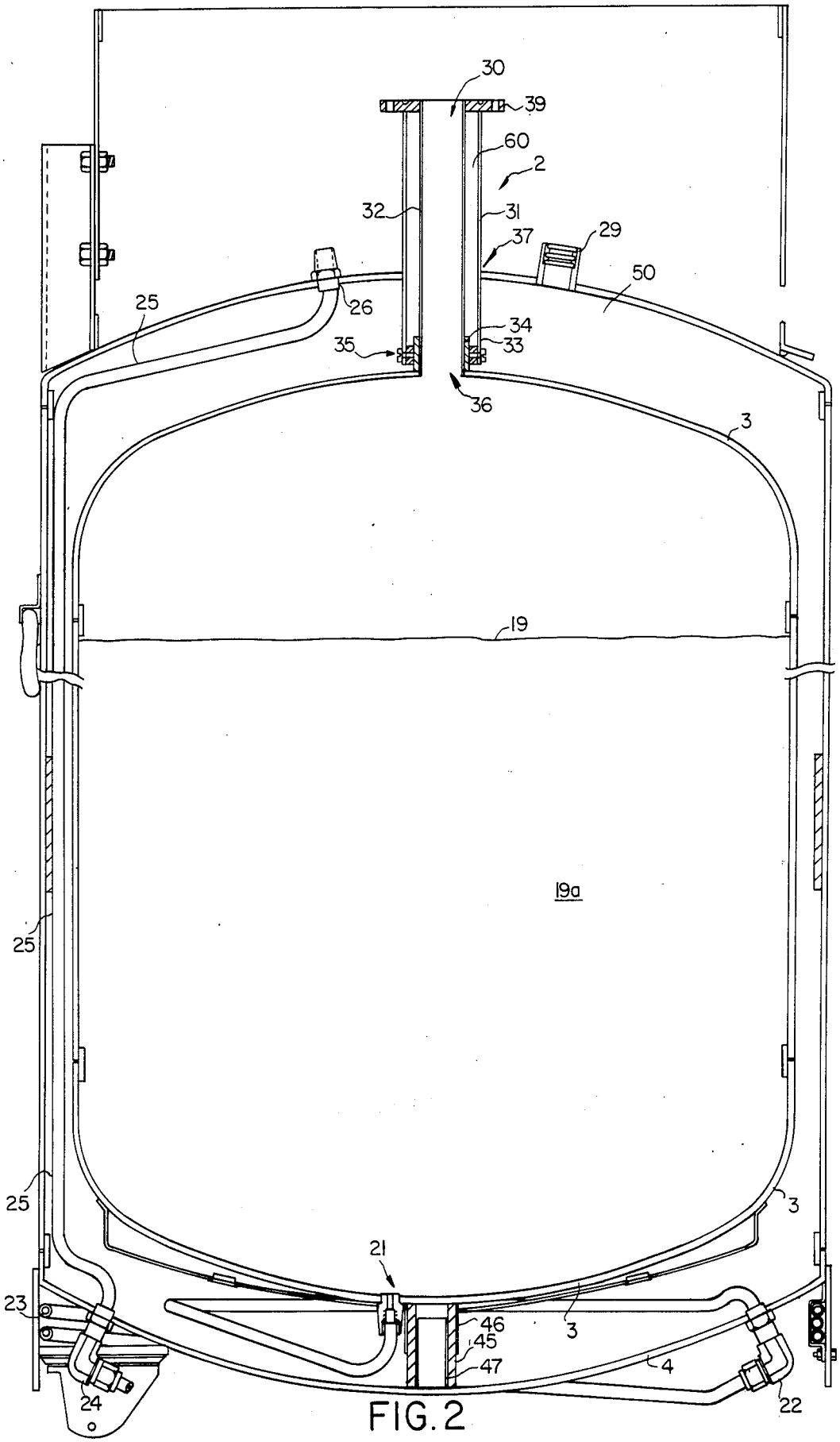
FIG. 2 is a cross section view of a liquefied gas container structure embodying some features of the present invention and showing in particular the low thermal conductivity channel from the inner shell to outside the container for structurally supporting the inner shell from the outer shell and providing access to the inner shell for the liquefied gas input/output tube that connects to control valves for loading liquefied gas into the container and for drawing liquefied gas from the container and feeding it to vaporizing coils outside the container shells.
Figure 3:
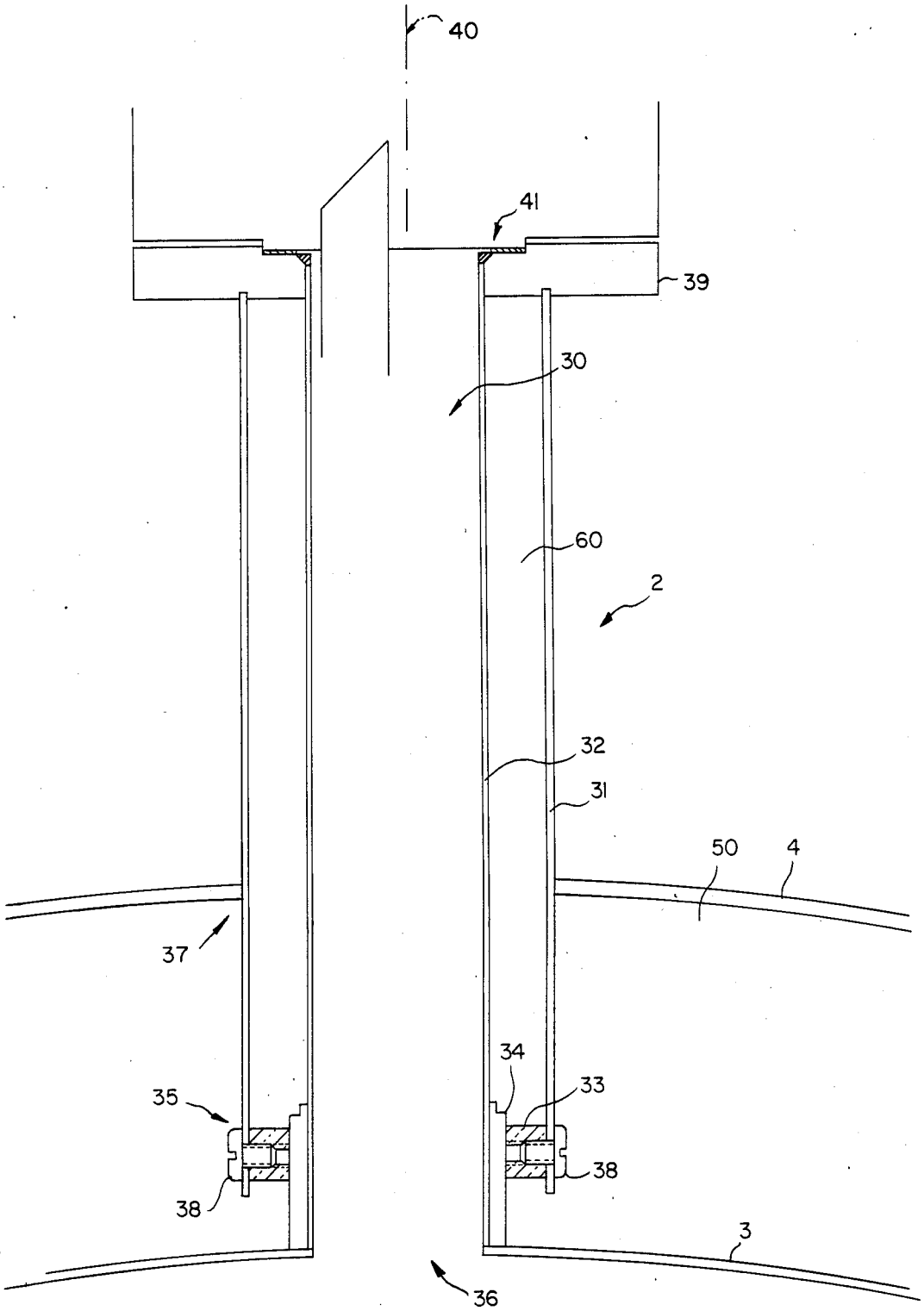
FIG. 3 is an enlarged cross section view showing details of the low thermal conductivity channel or neck assembly connecting the inside shell to the outside shell at the top of the container.

According to features of the present invention shown in FIGS. 2 and 3, the neck 2 that extends from the inner shell 3 of the container 1 provides access channel 30 into the inner shell that is vacuum insulated the full length of the channel. The channel and neck are formed by two concentric tubes, a thick wall outer structural tube 31 and a thin wall inner tube 32, the structural tube providing support for the inner shell from the outer shell and the thin wall tube providing the vacuum enclosed, low thermal conductivity channel 30 to the inner shell. A fiber glass spacer 33 is used between the extension of the structural tube from the outer shell into the vacuum space 50 and a heavy boss 34 welded to the top of the inner shell. Should the inner shell sway, the fiber glass spacer is moved by the boss against the structural tube at 35 which keeps the inner shell from moving so far that the seal of the thin wall inner tube 32 to the inner shell breaks. The fiber glass spacer 33 normally does not bear against the inner shell boss, and so there is essentially zero heat leak through the structure in normal use. The only time the spacer 33 bears against inner shell boss 34 is when the inner shell moves laterally. This is called "Lost Motion Support".

FIG. 2 shows the container 1 of the schematic of FIG. 1 and represents a typical container of the size and use described. The cross section view reveals the access channel and tubing connections to the container, but none of the control valves and pressure regulating systems of FIG. 1. FIG. 3 is an enlarged cross section view of neck 2 and access channel 30 showing details of the channel and support structure for the inner shell where it extends from the container to the control valve system shown in FIG. 1. The neck 2 extends between a central opening 36 at the top of inner shell 3 and a central opening 37 at the top of outer structural shell 4. The support structure of the neck includes boss 34 welded to the inner shell at the opening 36 and extending into vacuum space 50 concentric with the axis 40 of the container, and structural tube 31 which is welded to the outer shell at hole 37 and extends into the space 50 overlapping part of boss 34 and spaced therefrom by fiberglass spacer 33. Structural tube 31, spacer 33 and boss 34 are loosely connected by radial bolts 38 that screw firmly into the boss and fit loosely through holes in tube 31 and spacer 33. This structure allows some lateral motion of the top of the inner shell with respect to the outer shell, but not so much as would damage the seal of thin wall tube to the inner shell.

The other end of structural tube 31 extends upward beyond the outer shell to a sealing flange 39. Thin wall tube 32 is inside the structural tube and inside boss 34 and is welded to hole 36 in the inner shell or is welded to boss 34 and extends upward within tube 31 to flange 39 and is welded to the flange. Flange 39 is attached and sealed to a header 42, shown in FIG. 4, to which tubes 7 and 13 connect, and a liquid level fill gauge 43 is carried on the header as described more fully herein with respect to FIG. 4.

Thus, at the top of the container the connection from inner shell 3 to boss 34 and from the boss to structural tube 32, via spacer 33, and bolts 38 is a loose connection that allows limited lateral motion without damage to the thin wall tube seal to the inner shell. At the bottom of the container, the inner shell is held rigidly where it rests on a cylindrical fiberglass support member 45 that fits inside of metal sleeve 46 that is welded to the outside of inner shell 3 and fits outside of an inner sleeve 47 that is welded to the inside of the outer shell 4. This bottom support provides rigid support for the inner shell from the inside of the bottom of the outer shell and that support includes the thermal barrier offered by fiberglass support 45. In this way, the inner shell is supported at the top and bottom by connections to the outer shell that include thermal barriers provided by fiberglass spacer 33 at the top and fiberglass support 45 at the bottom.

Since the neck 2 at the top extends beyond the container to header 42 and thin wall tube 32 of the neck exposes the low temperature gas and liquid within the inner shell to structural outside tube 31, it must be insulated. Insulation is provided by the extension of the vacuum from space 50 up into the annular space 60 that encloses tube 31. Annular space 60 is sealed at flange 39 at one end and at the other end it opens through fiber glass spacer 33 to vacuum space 50. Thus, when a vacuum pump is attached to fitting 29 drawing down a vacuum in space 50 between the shells, it also draws down the same vacuum in the annular space 60 and so protects the access channel 30 in neck 2 from heat flow.

Vaporizer

In order to avoid the heat leaks associated with an output vaporizer coil located in the vacuum space between the shells as in prior cryogenic containers, the output vaporizer coil 9 in the present invention is located on the top of the container in ambient air. By this improvement alone, the loss of gas due to heat leak per day is reduced by more than fifty percent. This improvement greatly expands the range of uses for such a container. For example, a user using only a few high pressure gas cylinders a week can economically use the improved container to replace high pressure cylinders.

In addition, this improvement avoids the use of dissimilar metals, corrosive fluxes, and difficult soldering inside the space between shells and results in significant cost savings as well as improved reliability of the container.

According to another feature of the present invention, input and output to the container (loading and unloading) is through a single line of stainless steel tubing 5 that is simply lowered into access channel 30 opening at the top of the container from header 42 and output valve 10 controls the output flow through vaporizer coil 9 wherein the liquid is heated by ambient air and delivered at room temperature through the valve. Vaporizer 9 may be several hundred feet of copper tubing which has been formed in alternate pancake rolls as described more fully therein with respect to FIG. 4.

Figure 4:
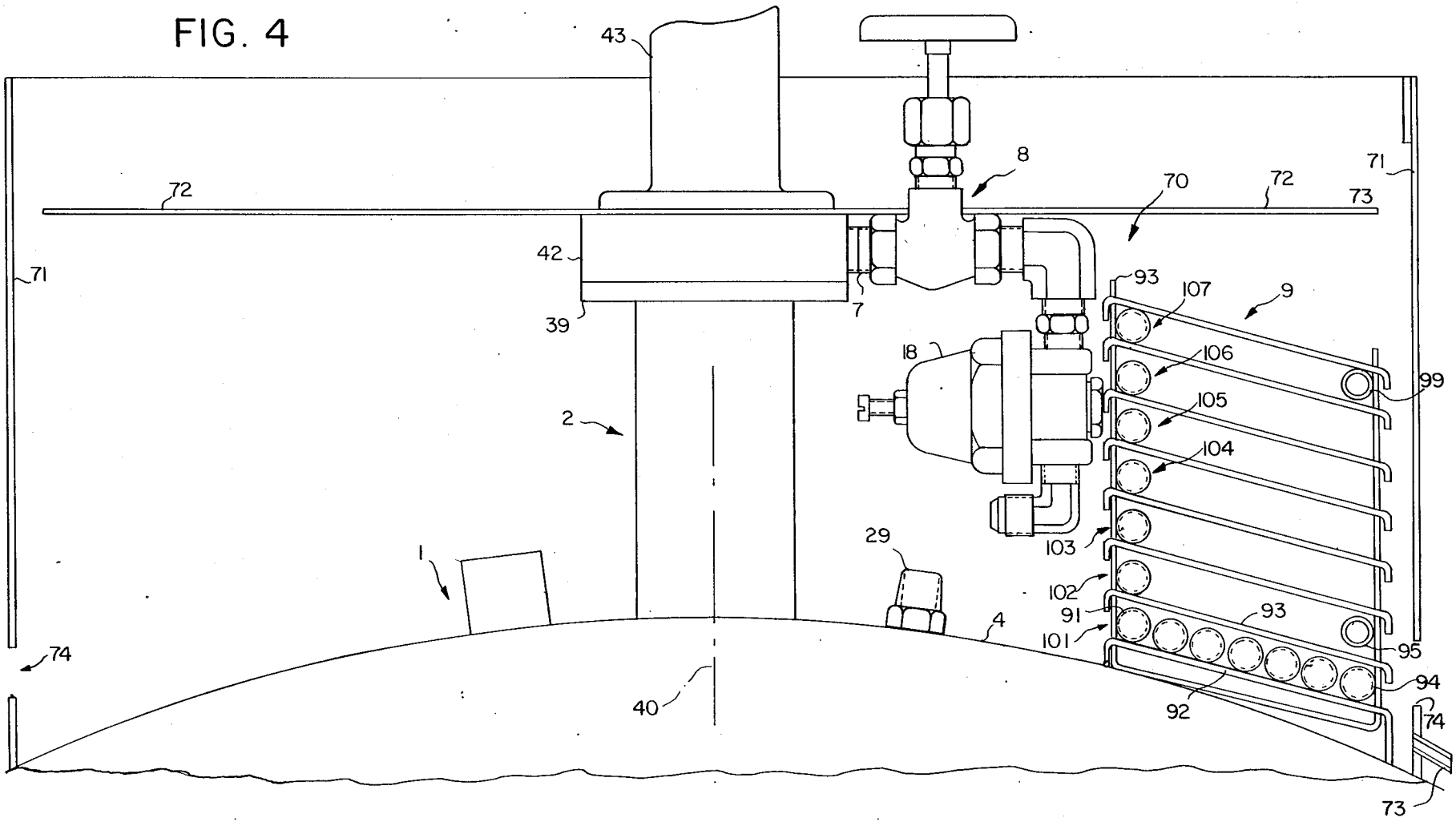
FIG. 4 is an enlarged cross section view showing details of the vaporizing coil, the input/output tube that feeds liquefied gas from the inside shell to the vaporizer and the gas use valve (output control valve) that controls flow to the user through the user.

Turning next to FIG. 4 there is shown an enlarged view of the top of the container, partially in cross section, showing outer shell 4, neck 2 and header 42, already described with reference to FIGS. 2 and 3. In addition, FIG. 4 shows liquid fill valve 8 leading from tube 7 from the header, pressure building regulator 18 and the arrangement of the vaporizer coils 9 at the top of the container within a partially enclosed area 70 that insures circulation of ambient air around and about the coils for efficient vaporization of the liquefied gas drawn from the container. A shroud 71 is spaced around the top of the container so that the cold air can circulate out from underneath the shroud. A cover 72 for coil 9 is provided on the top of the container with perforated holes in it to let ambient air in. Shroud 71 meets the outside of outer shell 4 at the top, providing a moat around the top for accumulating water condensate from ambient air from output vaporizer coils 9 and the rest of the valves etc. on top of the container. An overflow tube 73 pours this accumulation into a suitable collector so that it does not flow down around the container. This arrangement allows use of natural convection for warming the liquid flowing through the coils and avoids flow of condensation and melted ice down the container.

As shown in FIG. 4, the first turn of the coil from the header (tube 7) is turn 91 of bottom row 101 carried at the bottom step 92 of wire rack 93. This bottom row is wound from the inside to the outside and so the first turn 91 is at the inside of bottom step 92. The last turn 94 of bottom row 101 is followed by the first turn 95 of the second row 102 which is wound from the outside to the inside. Following that, the coil turn spacing repeats this sequence for each successive row from row 101 to row 107. Thus, the vaporizer turns alternately begin the rows of turns at the inside, and the outside. In this way the vaporizer conducts liquefied gas from the container over a path that spirals outward and downward, then inward and upward, then outward and downward, then inward and upward, and so forth.

Output vaporizer 9 receives the cold liquefied gas at the bottom row 101 and delivers gas from the outside turn 99 of top row 107. This arrangement provides a counter current flow of warm ambient air coming down from the top to the bottom and the cold liquefied gas coming in from the bottom and the warmer gas leaving from the top and insures the most efficient use of the ambient air that flows in by thermal convection at the top through openings in cover 72 and out at the bottom through openings such as 74. The benefit of this reversing pattern between the rows of coils is to insure gradual change from low temperature liquid to higher temperature gas as it flows through the coil and so the crossover tube from one row to the next row (ie from 94 to 95) does not pass much colder or much warmer tubes.

The container inner and outer shells and all tubing are preferably made of stainless steel. Fittings, valves and other controls are preferably made of brass. Output vaporizing coil 9 at the top is preferably made of copper and pressure building vaporizing coil 23 at the bottom is preferably made of stainless steel. There are several reasons for this including the fact that the thermal conductivity of copper is high, while the thermal conductivity of stainless steel is relatively lower. Vaporizers are the only parts of the container and its controls where high thermal conductivity is desired. Elsewhere, vacuum insulation is provided and structural connections to the inner shell are interposed between stainless steel parts to provide barriers to thermal conduction.

The container for liquefied gas described herein, its structures, insulation, vaporization, flow and controls incorporates in the several embodiments described all features of the present invention and represents the best known use of those features. It should be clearly understood that these features may be used in other equipments by those skilled in the art with some variations without departing from the spirit and scope of the invention set forth in the appended claims.

I claim:

1. In a container for low temperature liquified gas that provides the gas at relatively low pressure by drawing liquified gas from the container into a heat exchanger where it evaporates and feeding the gas from the heat exchanger to the user, the improvement comprising, (a) an inner shell containing said liquified gas,
(b) an outer shell containing said inner shell and enclosing a sealed shell insulating space between said shells
(c) means connected to said container for evacuating said shell insulating space,
(d) an opening in said outer shell,
(e) an opening in said inner shell in line with said outer shell opening,
(f) structural tube structurally attached and sealed to said outer shell opening and and extending therefrom through said insulating space to said inner shell around said inner shell opening,
(g) means supportively attaching said structural tube to said inner shell that permits movement of said inner shell relative to said structural tube up to a predetermined maximum,
(h) a sealing tube attached and sealed to said inner shell opening and extending therefrom through said structural tube defining a space therebetween,
(i) means for sealing said space between said tubes whereby said space between said tubes is evacuated when said shell insulating space is evacuated and
(j) a liquefied gas conduit leading from inside said inner shell, through said sealing tube to liquefied gas control means.

2. In a container for low temperature liquefied gas that provides the gas at relatively low pressure by drawing liquefied gas from the container into a heat exchanger where it evaporates and feeding the gas from the heat exchanger to the user, the improvement comprisng, (a) an inner shell containing said liquified gas,
(b) an outer shell containing said inner shell and enclosing a sealed shell insulating space between said shells
(c) means connected to said container for evacuating said shell insulating space,
(d) an opening in said outer shell,
(e) an opening in said inner shell in line with said outer shell opening,
(f) a structural tube structurally attached and sealed to said outer shell opening and extending therefrom through said insulating space to said inner shell around said inner shell opening,
(g) a spacer made of relatively low conductivity material acting between said structural tube and said inner shell, said spacer permitting movement of said inner shell relative to said structural tube up to a predetermined maximum,
(h) a sealing tube attached and sealed to said inner shell opening and extending therefrom through said structural tube defining a space therebetween,
(i) means for sealing said space between said tubes whereby said space between said tube is evacuated when said shell insulating space is evacuated and
(j) a liquefied gas conduit leading from inside said inner shell, through said sealing tube to liquefied gas control means.

3. A container as in claim 2 wherein, said spacer is ring-shaped.

4. In a container for low temperature liquefied gas that provides the gas at relatively low pressure by drawing liquefied gas from the container into a heat exchanger where it evaporates and feeding the gas from the heat exchanger to the user, the improvement, comprising, (a) an inner shell containing said liquified gas,
(b) an outer shell containing said inner shell and enclosing a sealed shell insulating space between said shells
(c) means connected to said container for evacuating said shell insulating space,
(d) an opening in said outer shell,
(e) an opening in said inner shell in line with said outer shell opening,
(f) an inner shell opening boss,
(g) a structural tube structurally attached and sealed to said outer shell opening and extending therefrom through said insulating space to said inner shell around said inner shell opening boss,
(h) a spacer made of relatively low conductivity material acting between said structural tube and said inner shell opening boss, said spacer permitting movement of said inner shell relative to said structural tube up to a predetermined maximum,
(i) a sealing tube attached and sealed to said inner shell opening and extending therefrom through said structural tube defining a space therebetween,
(j) means for sealing said space between said tubes whereby said space between said tubes is evacuated when said shell insulating space is evacuated and
(k) a liquified gas conduit leading from inside said inner shell, through said sealing tube to liquefied gas control means.

5. A container as in claim 4 wherein,
(a) said shells, boss and tubes are metal,
(b) said boss is welded to said inner shell opening and,
(c) said structural tube is welded to said outer shell opening.

6. A container as in claim 4 wherein,
(a) radial tapped holes are provided in said boss,
(b) radial bolt holes aligned with said radial tapped holes are provided in said structural tube and said spacer and,
(c) bolts through said thick wall tube and spacer holes screw into said boss tapped holes, limiting the lateral motion of said inner shell to the movement of said boss within said structural tube and spacer.

7. A container as in claim 4 wherein,
(a) said means for sealing said annular space between said tubes is a flange that connects to both.

8. A container as in claim 7 wherein,
(a) said sealing tube projecting end is welded to said flange.

9. A container as in claim 8 wherein,
(a) means are providing for connecting a vacuum source said shell insulating space whereby said shell insulating is evacuated and said annular space between said tubes is evacuated at the same time.

10. In a container for low temperature liquefied gas that provides the gas at relatively low pressure by drawing liquefied gas from the container into a heat exchanger and feeding it from the heat exchanger to the user, the improvement comprising, (a) an inner shell containing said liquefied gas,
(b) an outer shell containing said inner shell; and enclosing a sealed shell insulating space between said shells
(c) means connected to said container for evacuating said shell insulating space,
(d) an opening in said outer shell,
(e) an opening in said inner shell in line with said outer shell opening,
(f) means providing an insulated channel extending from outside said container through said outer and inner shell openings to the inside of said inner shell, vacuum sealed to said shells,
(g) a fluid control valve assembly outside of said container,
(h) means including a coil of tubing connected to said liquid gas conduit outside of said container arranged to intercept a flow of ambient air resulting in substantial heat flow from said ambient air to said liquefied gas causing said gas to vaporize within said coil of tubing and
(i) said coil includes sets of side by side turns of increasing diameter and said sets are stacked one upon another and the flow of liquefied gas in said coil turns is from the last turn of a set to the set next above the turn of said set next above immediately adjacent said last turn of the set blow,
(j) whereby the flow through said coil is progressively radially outward and then progressively radially inward and
(k) means connecting said coil of tubing to said fluid control valve assembly,
(l) whereby said control valve assembly controls the flow of gas to a user.

11. A container as in claim 10 wherein,
(a) said shells and said liquefied gas conduit are stainless steel and
(b) said coil is copper.

12. In a container for low temperature liquefied gas that provides the gas form at relatively low pressure by drawing liquefied gas from the container into a heat exchanger where it evaporates and feeding the gas from the heat exchanger to the user, the improvement comprising, (a) an inner shell containing said liquefied gas,
(b) an outer shell container said inner shell and enclosing a sealed shell insulating space between said shells
(c) means connected to said container for evacuating said shell insulating space,
(d) an opening in said outer shell,
(e) an opening in said inner shell in line with said outer shell opening,
(f) structural tube structurally attached and sealed to said outer shell opening and and extending therefrom through said insulating space to said inner shell around said inner shell opening,
(g) means supportively attaching said structural tube to said inner shell that permits movement of said inner shell relative to said structural tube up to a predetermined maximum,
(h) a sealing tube attached and sealed to said inner shell opening and extending therefrom through said structural tube defining a space therebetween,
(i) means for sealing said space between said tubes whereby said space between said tubes is evacuated when said shell insulating space is evacuated and
(j) a liquefied gas conduit leading from inside said inner shell, through said thin wall tube to liquified gas control means,
(k) a fluid control valve assembly outside of said container, (l) means including a coil of tubing connected to said liquid gas conduit outside of said container arranged to intercept a flow of ambient air resulting in substantial heat flow from said ambient air to said liquified gas causing said gas to vaporize within said coil of tubing and (m) means connecting said coil of tubing to said fluid control valve assembly, (n) whereby said control valve assembly controls the flow of gas to a user.

13. In a container for low temperature liquefied gas that provides the gas at relatively low pressure by drawing liquefied gas from the container through a conduit into a heat exchanger where said liquefied gas evaporates and feeding said evaporated gas from said heat exchanger to a user, an improved heat exchanger comprising, (a) a coil of tubing connected to said liquid gas conduit outside of said container arranged to intercept a flow of ambient air resulting in substantial heat flow from said ambient air to said liquified gas in said tubing causing said liquefied gas to vaporize within said coil of tubing, (b) said coil including sets of side by side turns of increasing diameter relative to a common vertical axis, said sets being stacked one upon another concentric with said vertical axis and the flow of said liquefied gas in said coil turns is from the last turn of a set to the set next above to the turn of said set next above immediately adjacent said last turn of said set blow, (c) whereby the flow through said coil is progressively upward from coil set to coil set and (d) means for feeding said vaporized gas from the upward-most set of turns of said coil of tubing to said user.

14. A container as in claim 13 wherein, (a) the coils of a set of progressively increasing diameter are progressively each lower than the preceding coil of the same set.

15. A container as in claim 14 wherein, (a) an ambient air flow guide is provided enclosing said sets of coil turns, (b) whereby ambient air flows in among said coil turns at the top-most set and out from said coil turns at the bottom-most set.

16. A container as in claim 13 wherein, (a) an ambient air flow guide is provided enclosing said sets of coil turns, (b) whereby ambient air flows in among said coil turns at the top-most set and out from said coil turns at the bottom-most set.

* * * * *